US006354450B1

(12) United States Patent
Zielinski et al.

(10) Patent No.: US 6,354,450 B1
(45) Date of Patent: Mar. 12, 2002

(54) LOCKING HELICAL CLOSURE SYSTEM

(75) Inventors: Peter M. Zielinski, Millville; David Manera, Petersburg, both of NJ (US)

(73) Assignee: Comar, Inc., Buena, NJ (US)

( * ) Notice: Subject to any disclaimer, the term of this patent is extended or adjusted under 35 U.S.C. 154(b) by 0 days.

(21) Appl. No.: 09/569,286

(22) Filed: May 11, 2000

Related U.S. Application Data

(60) Provisional application No. 60/133,910, filed on May 13, 1999.

(51) Int. Cl.[7] ..... B65D 41/06
(52) U.S. Cl. ..... 215/332; 215/351
(58) Field of Search ..... 215/332, 222, 215/341, 342, 349, 351

(56) References Cited

U.S. PATENT DOCUMENTS 728,981 A * 5/1903 Rose ..... 215/332
942,141 A * 12/1909 Hoffman ..... 215/332
3,451,576 A * 6/1969 Lewis ..... 215/332
3,927,783 A * 12/1975 Bogert ..... 215/332
4,387,821 A * 6/1983 Geiger ..... 215/332
4,482,073 A * 11/1984 Gagliardi ..... 215/332
4,485,932 A * 12/1984 Kusz ..... 215/332
5,727,704 A * 3/1998 Glynn ..... 215/332
6,082,565 A * 7/2000 Harrold ..... 215/222

* cited by examiner

*Primary Examiner*—Nathan J. Newhouse
(74) *Attorney, Agent, or Firm*—Eugene E. Renz, Jr., PC

(57) ABSTRACT

A locking helical closure system for containers consisting of three components. A closure cap, a neck finish, and a liner or stopper made of an elastic material. The closure system has engagement lugs that engage helical grooves and pockets on a neck finish preventing the closure cap from unwinding during the sterilization process.

2 Claims, 3 Drawing Sheets

LOCKING HELICAL CLOSURE SYSTEM

This application claims the benefit of U.S. Provisional Application No. 60/133,910 filed May 13, 1999.

FIELD OF THE INVENTION

BACKGROUND OF THE INVENTION

The present invention relates to improvements in container closure systems which are used for products which require autoclave sterilization processing. In these applications, it is important that the integrity of the sleeve be maintained. It has been found that in conventional systems due to the temperature variations of the process, in some instances thermal creep in the materials during autoclaving, which in prior art closures, caused a loosening effect producing in some instances breach of the seal. Maintaining a tight seal during the autoclaving process is important to maintain the integrity of the product. The present invention provides a closure system characterized by novel features of construction and arrangement ensuring a tight seal during autoclaving processes,

SUMMARY OF THE INVENTION

The present invention provides a closure system particularly characterized by features which make it particularly useful in autoclaving processes. To this end, the closure system comprises a sleeve-like insert which may be press fitted on the neck finish of a container having a spiral configuration terminating in a locking portion and a cap having lugs which engage in the slot and lock a liner in place in a sealed condition on the container.

BRIEF DESCRIPTION OF THE DRAWINGS

These and other objects of the present invention and various features and details of the operation and construction thereof are hereinafter more fully set forth with reference to the accompanying drawings, wherein.

DETAILED DESCRIPTION OF THE PREFERRED EMBODIMENTS

Figure 1:
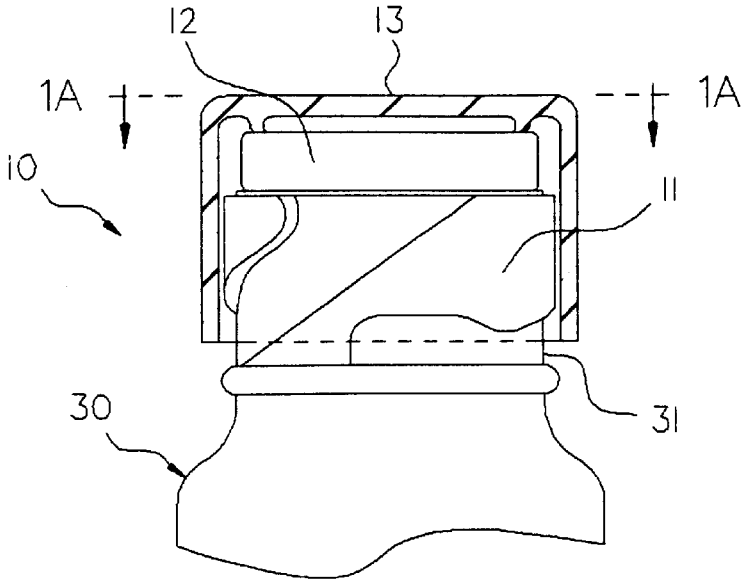
FIG. 1 is a side elevational view partly in section of the locking helical closure system of the present invention installed on a container with closure cap cut away.
Figure 1A:
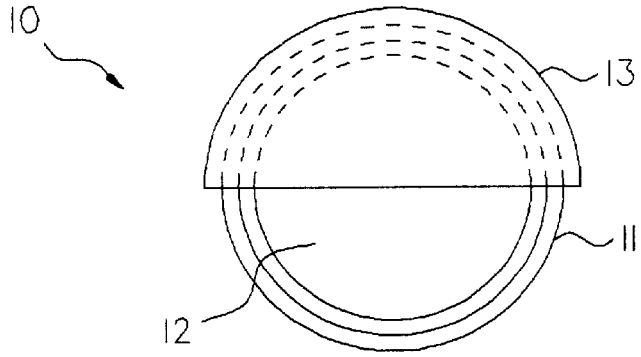
FIG. 1*a* is a top plan view of he cap broken away and neck finish sleeve of the locking helical closure system.
Figure 2:
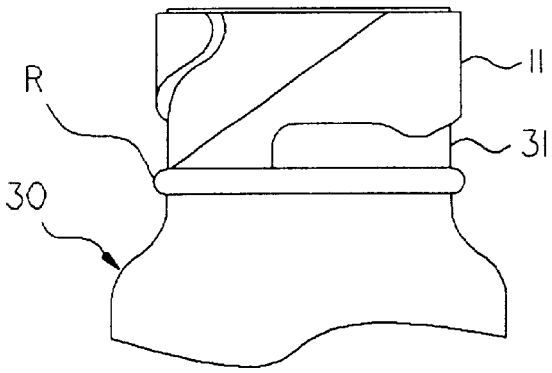
FIG. 2 more clearly illustrates the neck finish fitted onto the neck of a container.

Referring now to the drawings and more particularly FIGS. 1 and 2 thereof, the locking helical closure system (10) shown installed on a container (30) in FIG. 1 is designed to resist "unscrewing" during the autoclave sterilization process. Due to thermal creep of the materials involved, prior art closures become loosened causing the threaded closure to back off thereby breaching the seal rendering the container contents unusable.

Referring to FIG. 1, the closure system (10) of the present invention is comprised of three components; a cylindrically shaped neck finish sleeve (11), a liner disk or stopper (12) generally made of an elastic material sealing the contents of the container, and a cup shaped closure cap (13) shown cut away in FIG. 1. The neck finish sleeve (11) and the closure cap (13), shown in the engaged position in FIG. 1, interact cooperatively to prevent the closure system (10) from backing off during the sterilization process while closure cap (13) simultaneously applies a downward force to liner disk or stopper (12).

As best shown in the developed view of the insert sleeve (11), there are three helical grooves (15) formed on the exterior surface of the insert sleeve (11) having an entrance opening (15*a*) of a size to accommodate the lugs (14) and terminating in a locking slot (16) disposed in a transverse plane (P—P) perpendicular to the axis of the insert sleeve.

The parts of the locking system are assembled in the following manner. First the sleeve (11) is press fitted on the neck of the container until the bottom edge (11*a*) of the sleeves (11) abuts the circumferentially extending rib (R) separating the bottle finish and the body portion of the container. The liner seal (12) is then positioned over the discharge edge end of the container in the position shown in FIG. 1. The liner (12) is of a diameter smaller than the diameter of the sleeve (11) so that when the cap is positioned over the liner, the lugs (14) can align with and engage in the entrance end of the helical slots (15). Rotation of the cap in a clockwise direction seats the cap and locks the cap in place when the lugs (14) pass over the retention bumps (17) and engage in the locking slots (16).

Figure 3:
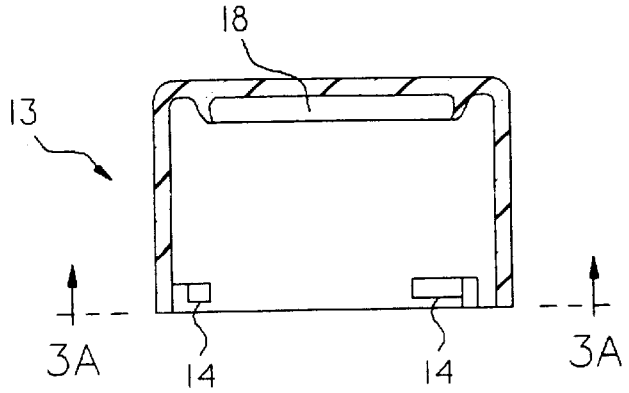
FIG. 3 is an isolated, cut away view of the closure cap showing engagement lugs and force focusing means.
Figure 3A:
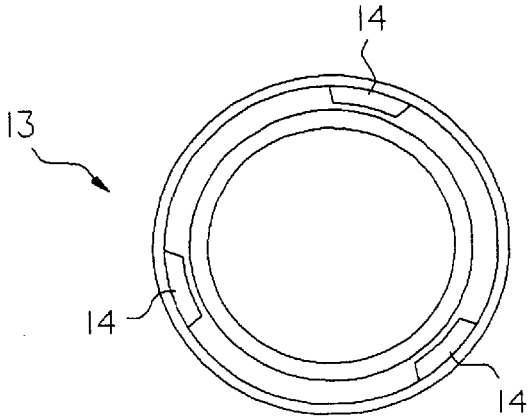
FIG. 3*a* is a bottom plan view of the cap of the closure system.
Figure 4:
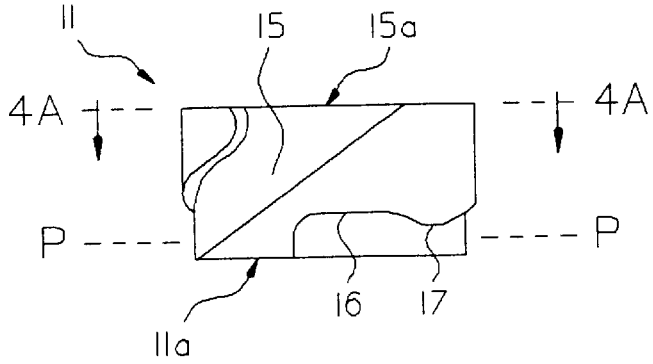
FIG. 4 is an isolated view of the neck finish showing helical slots, retention bumps, and pocket.
Figure 4A:
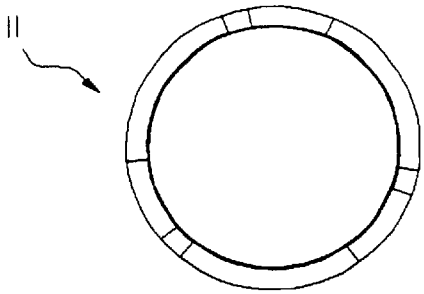
FIG. 4*a* is a top plan view of the neck finish sleeve.
Figure 5:
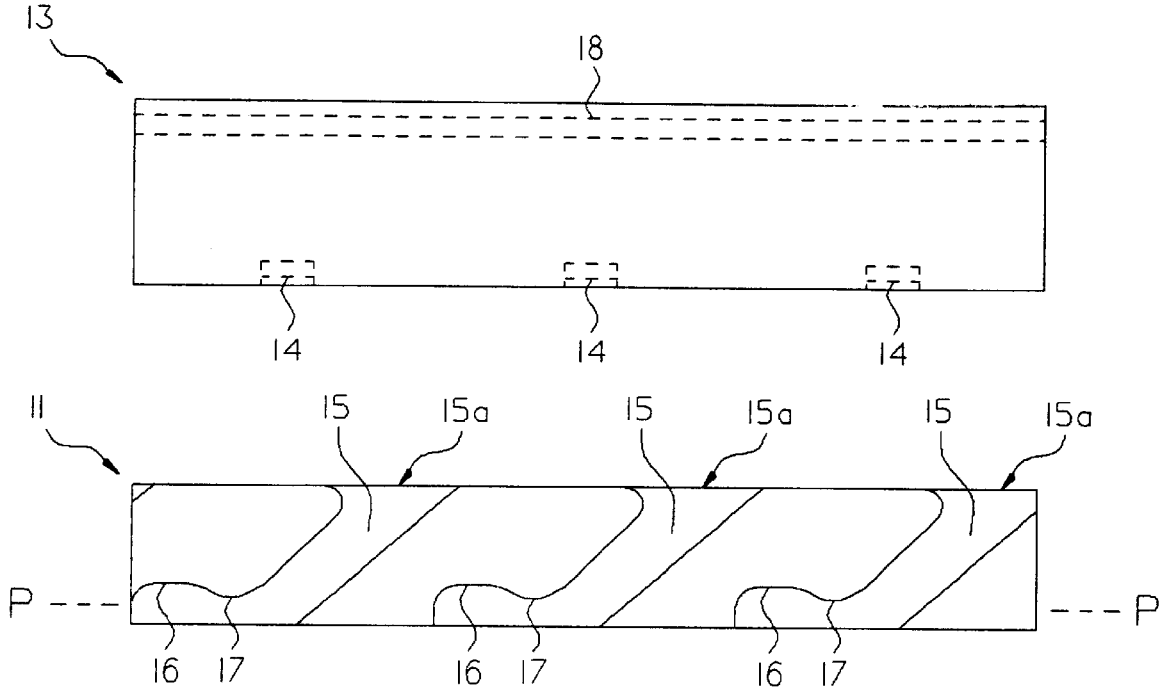
FIG. 5 is a developed view of both the cap and neck finish sleeve.
Figure 6:
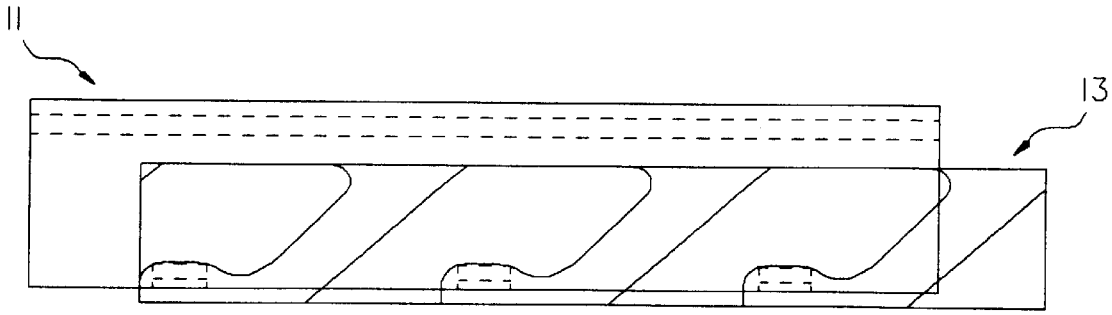
FIG. 6 is a developed view showing the engagement of the cap over the neck finish sleeve.

In FIG. 2, neck finish (11) is shown installed on neck (31) of container (30). Neck finish (11) is force fitted onto neck (31) of container (30) so as to prevent neck finish (11) from rotating during the application of closure cap (13). Closure cap (13) shown in an isolated cut away view in FIG. 3 more clearly illustrate its salient features. Engagement lugs (14) at the open end of closure cap (13) and force focusing means (18) at the closed end of closure cap (13) act cooperatively to secure liner or stopper (12) on to container (30). FIG. 4 is an isolated view of neck finish (11) showing helical slots 15 that spiral downward, pocket 16 that hold engagement lugs (14) and indicate when closure cap (13) is fully secured on container (30), and retention bumps (17) that prevent closure cap (13) from counter-rotating during the sterilization process.

To secure contents of container (30), neck finish (11) force fitted on neck (31) of container (30). Liner or stopper (12) is placed on top of container (30) or alternatively, is placed within closure cap (13) which is then placed over neck finish (11) such that engagement lugs (14) align with helical slots 15. To secure liner or stopper (12) on container (30), closure cap (13) is rotated pulling it downward along helical slots 15 simultaneously compressing liner or stopper (12) through force focusing means (18). A slightly increased forced rotation of closure cap (13) is required to move engagement lugs (14) over retention bumps (17) and into pocket 16.

To remove liner or stopper (12) and open container (30), sufficient force must be provided to closure cap (13) in a counter-rotating direction for engagement lugs (14) to overcome retention bumps (17). Past the retention bumps (17), engagement lugs (14) unwind along helical slots 15 releasing closure cap (13) and liner or stopper (12) making contents of container (30) available.

Even though particular embodiments of the present invention have been illustrated and described herein, it is not intended to limit the invention and changes and modifications may be made therein within the scope of the following claims.

What is claimed is:

1. A closure assembly for a container having a generally cylindrical neck comprising a neck finish having a series of circumferentially spaced helical grooves defined in the exterior surface, each groove terminating adjacent the lower end of the finish in an elongated locking slot extending transversely to the container finish, a downwardly depending projection at the entrance to said slot defining a stop, a cap of a cup-shaped form having a top and a depending skirt, a series of circumferentially spaced radially inwardly directed lugs projecting from the lower edge of the skirt and circumferentially equi-spaced to align with said helical grooves whereby when the cap is rotated relative to the container, the lugs traverse the grooves and engage in the bottom of the locking slot to hold the cap on the container, a resilient seal liner pressed against the axial end face of the bottle finish by a circumferential depending continuous rib on the inside of the cap adjacent the skirt in general axial alignment with the inwardly projecting lugs on the skirt engaging the liner and biasing the cap upwardly to seat said lugs in said grooves when the lugs are engaged in the locking slots.

2. A closure assembly as claimed in claim 1, wherein the diameter of the liner is slightly less than the diameter of a circular trace of a circle through the inner edge of the helical grooves on the exterior surface of the neck finish of the container.

* * * * *